US005100278A

United States Patent [19]

Westlake

[11] Patent Number: 5,100,278

[45] Date of Patent: Mar. 31, 1992

[54] RAILROAD LOCOMOTIVE CRANE BOOM APPARATUS

[75] Inventor: James Westlake, Lake View, N.Y.

[73] Assignee: Eastern Railway Supplies, Inc., West Seneca, N.Y.

[21] Appl. No.: 630,862

[22] Filed: Dec. 20, 1990

[51] Int. Cl.[5] ..... B65F 9/00; B66C 23/08

[52] U.S. Cl. ..... 414/339; 212/232; 212/238; 212/251; 212/265; 414/561; 414/555; 104/5

[58] Field of Search ..... 212/255, 187, 260, 261; 414/546, 555, 339, 345, 399, 392, 561; 104/2-6

[56] References Cited

U.S. PATENT DOCUMENTS

| | | | |
|---|---|---|---|
| 2,831,589 | 4/1958 | Way | 212/245 |
| 4,085,853 | 4/1978 | van der Lely | 212/260 |
| 4,099,635 | 7/1978 | Leonard et al. | 414/339 |
| 4,175,902 | 11/1979 | Herzog et al. | 414/339 |
| 4,461,369 | 7/1984 | Amadoo | 212/261 |
| 4,953,720 | 9/1990 | Okano et al. | 212/261 |

FOREIGN PATENT DOCUMENTS 2434494 2/1976 Fed. Rep. of Germany ..... 212/255

*Primary Examiner*—Joseph F. Peters, Jr.
*Assistant Examiner*—R. B. Johnson
*Attorney, Agent, or Firm*—Sommer, Oliverio & Sommer

[57] ABSTRACT

An improved locomotive crane boom generally indicated at 10 has of a first member 11, second member 12, and third member 13 each pivotally connected at various pivot points to one another and to locomotive crane 14. A series of pistons and cylinders, 19, 20 and 21, powered by hydraulic pump 23 and fluid source 34, may be selectively extracted or retracted thereby permitting the improved boom to be positioned at any point along the length of a typical gondola car 17 to be unloaded. In operation, locomotive crane 14 with the included improved boom 10 does not need to be uncoupled from gondola car 17 for unloading since the improved boom may be articulated such that unloading magnet 24 or any other appended appliance may be positioned across the entire length of car 17 through the selected extraction and retraction of the pistons and cylinders and pivoting of the boom members 11, 12 and 13.

3 Claims, 3 Drawing Sheets

RAILROAD LOCOMOTIVE CRANE BOOM APPARATUS

TECHNICAL FIELD

This invention relates generally to the field of railroad locomotive cranes and in particular, to an improved crane boom for use therewith.

BACKGROUND ART

Typically, specially configured railroad locomotives having appended crane booms are used in manufacturing facilities or railroad yards to load and unload train cars with raw materials, scrap, product or the like. Such locomotive cranes are self-propelled like a typical locomotive and accordingly, are able to freely travel to destinations within a manufacturing facility or railroad yard for use. Locomotive cranes in the known prior art are adapted to include an appended crane boom controlled from the locomotive cab by the operator. Usually, the appended crane boom, at its outer end, is adapted to receive through the use of cables or otherwise, a device for loading and unloading, e.g., a magnet or scoop.

In practice, locomotive cranes are typically used to load and unload "gondola" cars, i.e., open-top substantially elongated railroad cars, containing, for example, scrap metal. The known prior art, however, is limited to locomotive cranes having what are commonly referred to as "lattice booms" appended thereto. Specifically, as shown in FIG. 1*a*, reference numeral 25, lattice booms are constructed of a series of support trusses and fixed in a linear position. Lattice booms are, however, free to pivot at their point of attachment to the locomotive crane and are free to swing through a vertical arc to shorten the radius of the lifting point from the locomotive crane.

In operation, the known prior art cranes are moved to a position adjacent to a gondola car to be loaded or unloaded, and the operation is then commenced. Because the lattice type boom is not capable of being articulated or pivoted at points along its length, the operator must carefully position the locomotive at various distances from the gondola car or raise and cover the lattice boom at full length to compensate for the various loading points along the gondola car length. Accordingly, to unload that portion of the gondola car closest to the locomotive, the locomotive must be moved away from the load/unload point to a distance equal to that of the inflexible lattice boom or, alternatively, the angle of the lattice boom must be raised to a generally unstable position. In either case, the operator is somewhat removed from the immediate area of the load/unload point. In addition, the lattice boom is incapable of full extension through the length of the gondola car because of the low pivot point of the boom relative to the higher sides of the gondola car. An attempt to make an extension to alleviate this problem again results in possible hazardous and unstable conditions.

Use of the lattice crane boom for loading and unloading has, in turn, proved to be inefficient, cumbersome and extremely time-consuming. Moreover, the inflexibility of the lattice crane boom requires that an extended length of track be available for loading operations and further, unavoidably results in the operator being normally positioned at a point removed from the gondola car edge. This, too, greatly diminishes the efficiency of the loading or unloading operation.

As set forth below, the improved device serves to correct these deficiencies.

DISCLOSURE OF THE INVENTION

With parenthetical reference to the various drawing figures and reference numerals, the invention is generally shown to comprise an improved locomotive crane boom (e.g., 10).

The improved boom specifically comprises a first member (e.g., 11); a second member (e.g., 12) and a third member (e.g., 13) pivotally connected to a locomotive crane car (e.g., 14) at a first pivot point (e.g., 15) and to one another at a second pivot point (e.g., 16) and a third pivot point (e.g., 18) such that the relevant boom members may be articulated around said pivot points.

The boom further comprises a first actuator (e.g., 19) operatively connected at its one end to the locomotive crane car and at its other end to the approximate midpoint of the first member, for selectively pivoting the first member around the first pivot point; a second actuator (e.g., 20) interposed between the first member and second member for selectively pivoting those members around the second pivot point; and a third actuator (e.g., 21) interposed between the second and third members for selectively pivoting those members around the third pivot point. The invention further includes a locomotive crane cab (e.g., 22) for an operator and controls for the device; a hydraulic fluid source (e.g., 34) and pump (e.g., 23) with accompanying hydraulic lines (e.g., 29) arranged to selectively supply the actuators; and a coupling apparatus (e.g., 30) for engaging the locomotive crane car to a gondola car (e.g., 17) or other similar railroad car to be unloaded. The improved boom further includes a third member end connection point (e.g., 31) adapted to support an electromagnetic unloading means (e.g., 24) or other similar appliance for loading and unloading material from the gondola car.

In operation, the improved crane boom, mounted to the locomotive crane car, is positioned adjacent to the gondola car to be unloaded and is hydraulically articulated by the actuators through various angles (e.g., $\theta_2$, $\theta_3$, $\theta_4$, $\theta_5$) thereby enabling the gondola car to be loaded or unloaded without uncoupling from the locomotive crane or extensive movement and positioning of the locomotive crane car during operation.

Accordingly, the object of the invention is to provide a flexible and efficient improved crane boom and method for loading and unloading a railroad train cars.

Another object of the invention is to provide an improved crane boom for use with railroad locomotive cranes that is adapted to articulate at various points along its length during the course of operation.

Still another object of the invention is to provide an improved locomotive crane boom and method for loading and unloading railroad cars that requires little or no movement or uncoupling of the locomotive crane and object railroad car to be unloaded.

These and other objects and advantages are and will become apparent from the foregoing and from the written specification, drawings and claims herein.

MODE(S) OF CARRYING OUT THE INVENTION

Figures 1, 1A:
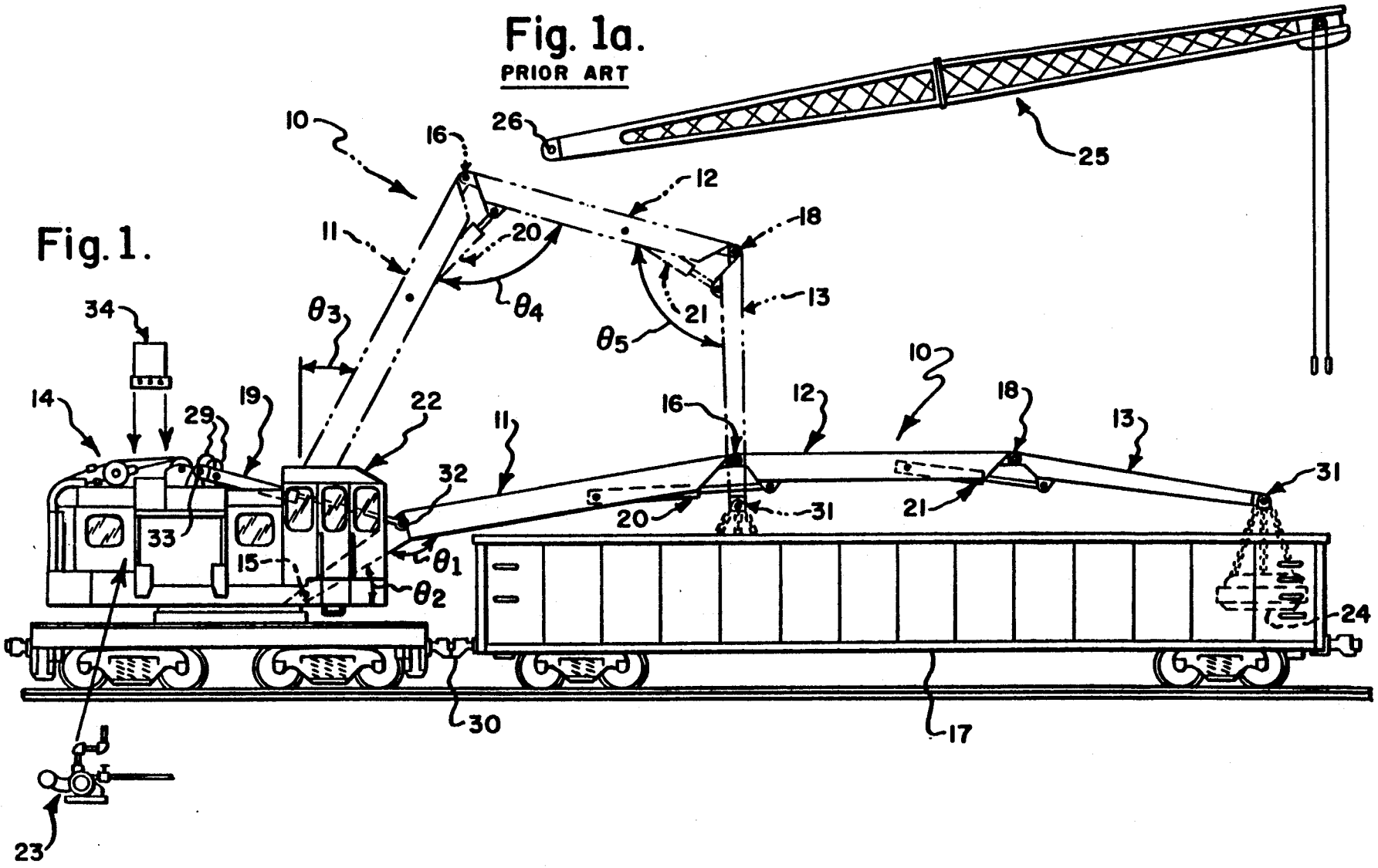
Fig. 1a. PRIOR ART
FIG. 1 is an elevation of the improved locomotive crane boom appended to a locomotive crane car coupled to a gondola car to be unloaded.
FIG. 1*a* is an elevation of a prior art lattice crane boom.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Turning first to FIG. 1, the improved railroad locomotive crane boom, generally indicated at 10, is shown to be appended to and operated from a railroad locomotive 14 which is typically coupled by way of a standard railroad coupling device 30 to a gondola car 17 to be loaded or unloaded.

FIG. 1 shows the improved boom to generally include an elongated first member 11 formed to include a slight angle, $\theta_1$, near the midpoint thereof. First member 11 is, at its one end, pivotally attached to locomotive crane 14 at first pivot point pair 15, 15*a* located on the locomotive frame. The improved boom is further shown to comprise an elongated second member 12, which, at its one end, is pivotally connected to the extending end of the first member at second pivot point 16. At its other end, second member 12 is pivotally attached to elongated third member 13 at third pivot point 18, while third member 13, at its other end, includes an attachment eyelet 31 capable of receiving and appending an electromagnet 24 or other similar loading appliance. Continuing to advert to the general description of the device provided in FIGS. 1 and 2, the improved boom is shown to be selectively articulated around the various pivot points by use of a series of actuators, i.e., pistons and cylinders, interposed and appended to the various boom members and locomotive frame. In particular, first piston and cylinder pair 19, 19*a* is pivotally affixed at its cylinder ends to the top of the locomotive at pivot points 33, 33*a*, while the attendant piston rods extend and are pivotally attached to first member pivot points 32, 32*a* along the length of first member top surface 35. Accordingly, the first member (and connected second and third members) is adapted to be pivoted around pivot points 15, 15*a* by the selective operation of piston and cylinder pair 19, 19*a*.

Figure 2:
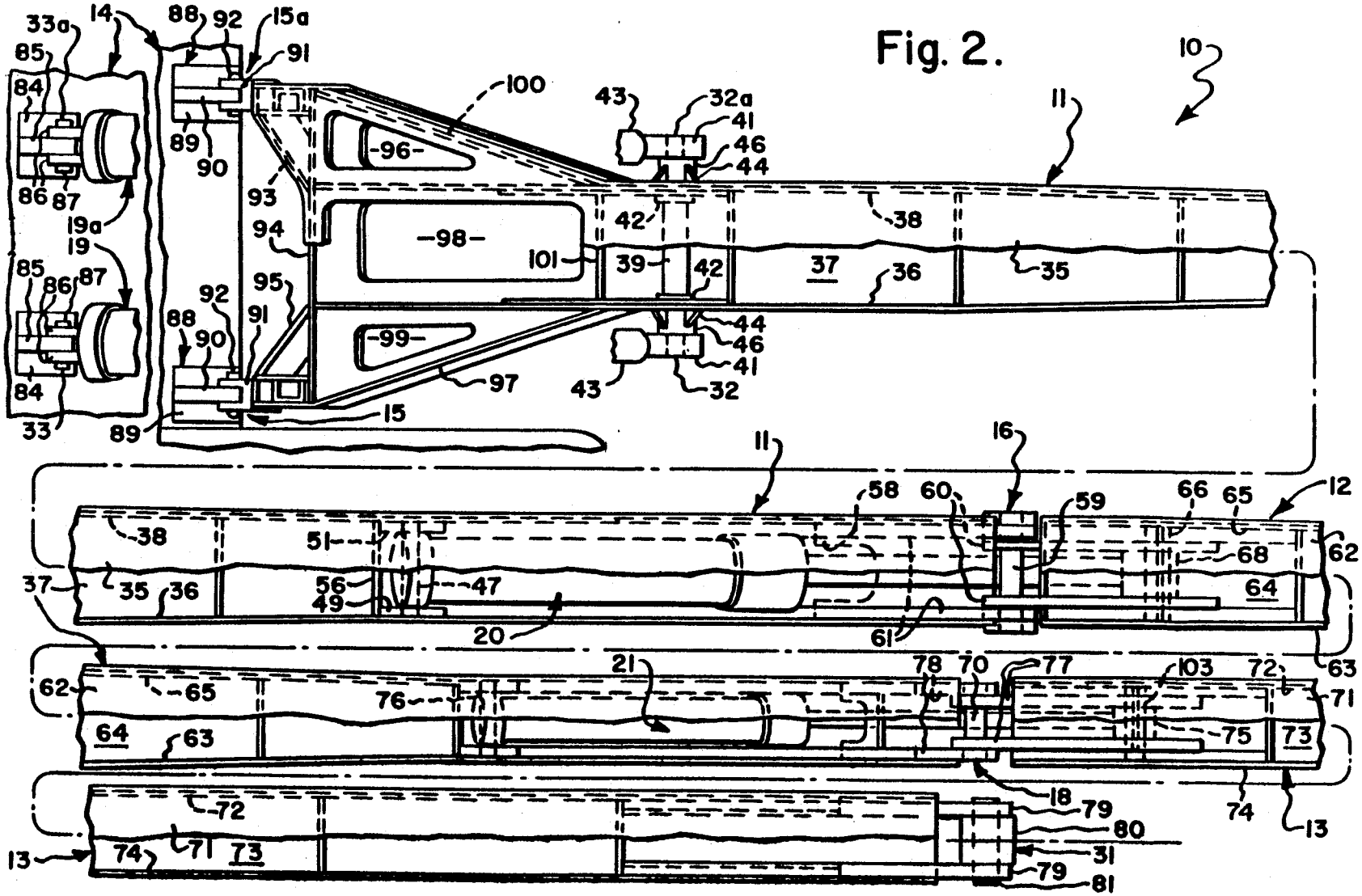
FIG. 2 is a top plan view in partial section of the improved crane boom assembly.

Continuing to advert to FIGS. 1 and 2, second piston and cylinder 20 is shown to be generally interposed between the outer end of first member 11 and an end of second member 12 and is arranged to cause the first and second members to selectively pivot around second pivot point 16 depending upon the extraction or retraction of the second piston and cylinder piston rod. In a like manner, third piston and cylinder 21 is interposed between the end of second member 12 and one end of third member 13 and is arranged to selectively pivot the second and third members around pivot point 18 depending upon the extraction or retraction of the third piston and cylinder piston rod.

Thus, as shown in FIG. 1, the crane boom members may be articulated and pivoted through various angles (e.g., $\theta_2$, $\theta_3$, $\theta_4$, and $\theta_5$) by the selective retraction of the first, second and third piston and cylinders thereby enabling magnet 24 (or other similarly appended loading appliances) attached to end eyelet 31 of the third member to be positioned anywhere along the length of gondola car 17 without uncoupling from locomotive crane 14.

Adverting now to FIGS. 3–7, the design features of the improved boom are shown in detail and in section. In particular, FIGS. 3 and 4 describe boom first member 11 as comprising a substantially rectangular hollow member formed by the intersection of top plate 35, left side plate 36, bottom plate 37 and right side plate 38. The first member plate components are formed and joined in a manner to include angle $\theta_1$ at the approximate midpoint thereof.

Figures 3, 4, 5, 6, 7:
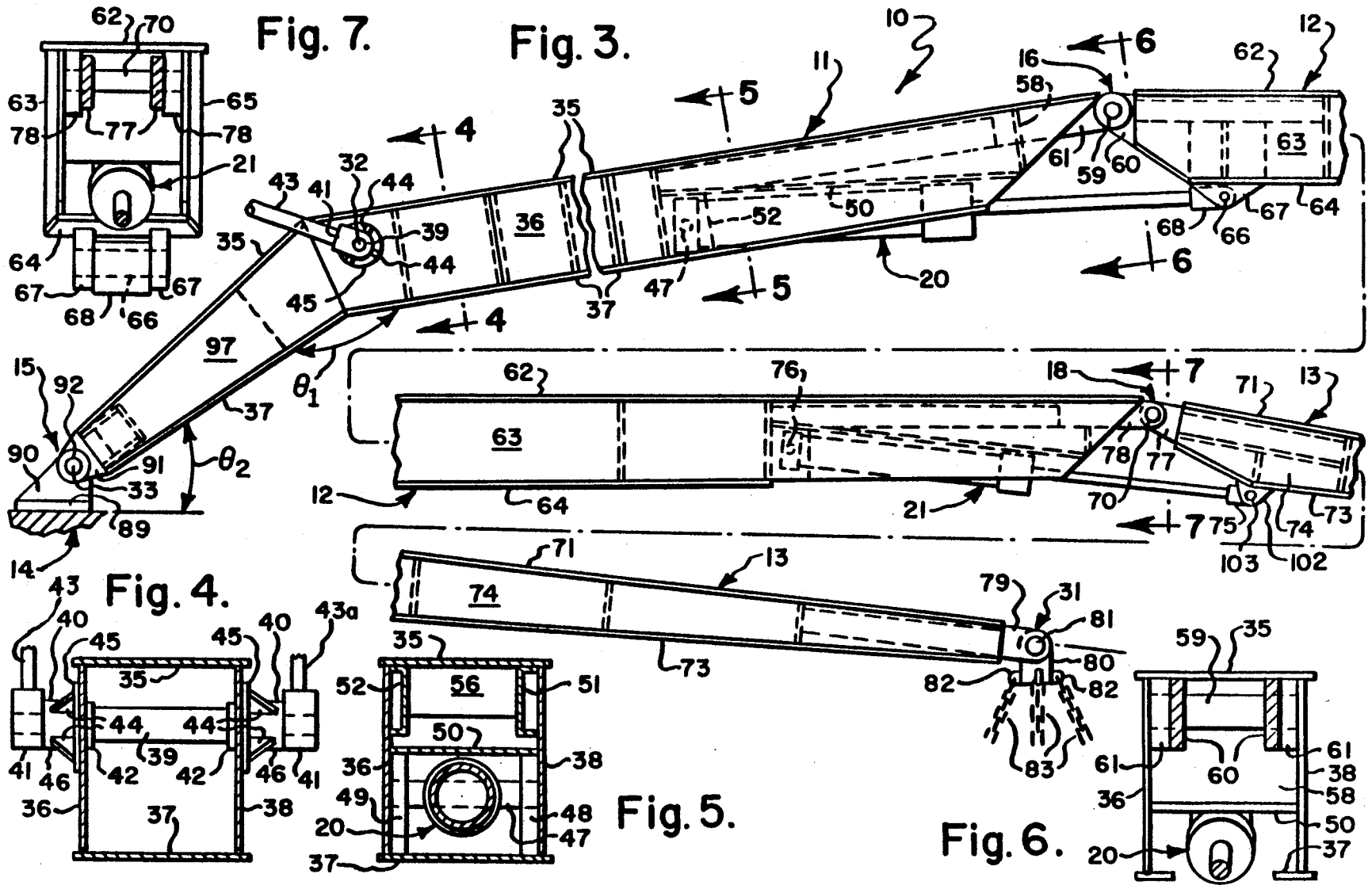
FIG. 3 is an elevation of the improved crane boom first member, second member and third member.
FIG. 4 is a transverse section of the first member taken along 4—4 of FIG. 3.
FIG. 5 is a transverse section of the first member taken along 5—5 of FIG. 3.
FIG. 6 is a transverse section of the second member taken along 6—6 of FIG. 3.
FIG. 7 is a transverse section of the third member taken along 7—7 of FIG. 3.

Continuing to advert to FIGS. 2, 3 and 4, first member 11 is further shown to be pivotally joined at its one end to locomotive crane body 14 at pivot points 15, 15*a* and also to the top of the cab by first piston and cylinder pair 19, 19*a*. Turning specifically to FIG. 2, the cylinder portion of piston and cylinder pair 19, 19*a* is attached to the locomotive crane cab top at corresponding pivot points 33, 33*a*. Pivot points 33, 33*a* specifically include a substantially rectangular base plate 84 having an upwardly extending rectangular attachment member 85 thereon, while cylinder 19, 19*a* at its end, terminates in a complementary cylinder attachment prong 86 capable of receiving attachment member 85 therebetween. Each of the attachment member and attachment prong have complementary through-holes for accepting a cylinder attachment pin 87. Accordingly, when assembled, piston and cylinder pair 19, 19*a* is free to pivot upwardly around pin 87 as piston rod 43 is retracted into the cylinder body.

Adverting now to FIGS. 3 and 4, the first piston and cylinder pair 19, 19*a*, at its rod ends 43, is shown to be pivotally attached to first member 11 just above angle $\theta_1$ at pivot point 32, 32*a*. In particular, the rod ends terminate in an included mounting plate 41 having a through-hole to aid mounting. First member 11, in turn, is shown to include a mounting pin 39 arranged to traverse the first member cross-section through side plates 36 and 38. Pin 39 is supported, on each side of the first member, by inner support shoulder 42, a substantially rectangular plate mounted on the inside of each of the member sides and having a through-hole for receiving pin 39.

Pin 39 is supported on the outside of first member sides 36 and 38 by an identical outer support shoulder 40 comprised of a substantially rectangular support plate 45, including a through-hole, and mounted against the outer surface of sides 36 and 38; a specially configured hollow cylindrical member 46 extending away from support plate 45 and capable of receiving pin 39 therethrough; and support struts 44 extending at an angle from support plate 45 to the outer edge of extending cylindrical member 46. Accordingly, when assembled, pin 39 is interposed through the first member sides and support devices and is received in the through-hole of piston rod mounting plate 41. Thus, the first piston and cylinder pair 19, 19*a* is mounted to the locomotive cab at pivot points 33, 33*a* and to the first member at pivot points 32, 32*a*.

Adverting now to FIGS. 2 and 3, the first member is also shown at its lower end to be pivotally mounted to the base of locomotive crane 14 at pivot points 15, 15*a*. In particular, as shown in FIG. 2, first member 11 is, at its lower end portion, a substantially triangular or wishbone shaped hollow member terminating in a pair of prong-like mounting members 91 extending from the bottom portion of the first member formed by the intersection of inwardly angled surface 93, horizontal surface 94 and inwardly angled surface 95. Angled side surfaces 97 and 100 join side surfaces 36 and 38 of the first member at a point approximately coincident with angle $\theta_1$. Top plate 35 is specially configured to include triangular through-spaces 96 and 99 and intermediate rectangular through-space 98. Support member 101 traverses the width formed by sides 36 and 38 for additional support of the first member just behind pivot point 32, 32*a*.

Continuing to advert to FIG. 2, the mounting of the first member to locomotive crane body 14 at pivot points 15, 15*a* is illustrated. In particular, mounting assembly 88 is shown to include substantially rectangular base plate 89 having an upwardly extending mounting member 90 extending therefrom. Mounting member 90 is configured to fit within the prongs of complementary prong-like mounting member 91. Each of the mounting members have through-holes for receiving mounting pin 92 therethrough.

Thus, the appended first member (and remaining connected boom members) are also free to pivot about points 15, 15*a*. Specifically, those of ordinary skill in the art will appreciate that as the first piston and cylinder pair 19, 19*a* is retracted or extracted, the improved boom will pivot about points 15, 15*a*.

As best illustrated in FIG. 1, it will also be appreciated that when pivoted to its lowest position, the first piston and cylinder, pair 19, 19*a* is configured such that the combination of angles $\theta_1$ and $\theta_2$, will be of sufficient incline for the first member to avoid contact with the edge or top of standard gondola car 17. In practice, angle $\theta_2$ will be approximately 55°. Moreover, when pivoted to its uppermost position (i.e., when piston and cylinder pair 19, 19*a* is in the fully retracted position) the first member will form an angle $\theta_3$ of approximately 30° from the vertical. As set forth in detail below, this flexibility of the first member, together with the appended second and third members, permits the improved boom to traverse the entire length of the gondola car to be unloaded without uncoupling or movement of the locomotive crane.

Adverting now to FIGS. 3 and 5, second piston and cylinder 20 is shown to be mounted between the pivotal joining point 16 of first member 11 and second member 12. Specifically adverting to FIG. 5, piston and cylinder 20 is shown to be mounted at its cylinder end within the hollow cross-section of first member 11 by mounting pin 47 traversing the width of first member side plates 36 and 38. At this point, first member 11 is reinforced along its length by various support structures interposed within the cross-section. In particular, rectangular support plate 56 joins side channels 51 and 52 positioned between the top and side portions of the first member. Intermediate horizontal plate 50 and vertical extending side plates 48 and 49 further support the first member structure while allowing piston and cylinder 20 to protrude therefrom and ultimately join second member 12 at its adjoining end portion.

Turning to FIGS. 2, 3 and 7, second member 12 is a substantially hollow member of rectangular cross-section comprised of top plates 62, side plates 63 and 65 and bottom plate 64. Second member 12 also includes at its one end a vertically downwardly extending two-pronged mounting plate 67 capable of receiving second cylinder rod specially configured end portion 68 therebetween. Each of the mounting plate 67 and rod end portion 68 have complementary through-holes for receiving joining pin 66. Accordingly, by selective extraction and retraction of second piston and cylinder 20, the first and second members may be articulated and pivoted to form various angles therebetween. Specifically, as shown in FIGS. 3 and 6, the first and second members are pivotally a two-pronged connected at pivot point 16. Turning to FIG. 6, the end of second member 12 terminates in a two-pronged connecting end plate 60 which fits within the inside of first member side plates 36 and 38 and reinforcing member 61 thereon. Connecting plate 60 and reenforcing plate 61 further include complementary through-holes for receiving cylinder mounting pin 59 which traverses the width of first member 11. Specially configured support plate 58 is further interposed between side plates 36 and 38 to lend support for the suspended piston and cylinder 20.

Accordingly, members 11 and 12 are free to pivot around point 16 depending upon the extraction or retraction of second piston and cylinder 20. As shown in FIG. 1, when piston and cylinder 20 is fully retracted, included angle $\theta_4$ is formed therebetween. In practice, this angle will approximate 80° upon full retraction.

Adverting now to FIGS. 2, 3 and 7, third member 13 is shown to be a substantially hollow member of rectangular cross-section comprised of top plate 71, right side plate 72, bottom plate 73 and left side plate 74. Substantially rectangular attachment plate 79 extends from the unattached end of the third member 13 in a prong-like manner and is adapted to receive appliance mounting collar 80 therebetween. Mounting collar 80 and attachment plate 79 have complementary through-holes for receiving mounting pin 81 therethrough and accordingly, collar 80 is free to pivot around a pivot point generally indicated at 31. Further, collar 80 also includes at its lower end, a series of attachment eyelets 82 capable of receiving magnet support chains 83 at various points. Accordingly, magnet 24 (or any other suitable appliance) is freely suspended from the end of the third member for positioning over a gondola car or other point for loading or unloading.

Continuing to advert to FIGS. 3 and 7, second member 12 and third member 13 are shown to be pivotally connected at pivot point 18. In particular, as shown in FIG. 7, substantially rectangular mounting plate 78 is interposed within the inside of side plate 63 and 65 of the end of second member 12 and protrudes away therefrom forming a prong-like member which is adapted to receive therebetween a similarly configured mounting plate 77 extending from third member 13. The two prong-like mounting plates 77 and 78 are adapted to receive mounting pin 70 thereacross through the use of complementary through-holes. Thus, the second and third members are pivotally connected at point 18 in an identical manner as that of the first and second member at point 16.

As best shown in FIG. 3, third piston and cylinder 21 is pivotally mounted at its cylinder end within the inside surface of second member 12 by interposed mounting pin 76 and, at its rod end, to the end of third member 13. In particular, third member 13 includes at its attached end, a two-pronged downwardly extending mounting plate 101 interposed within the inside surface of the third member sides 72 and 74. Piston rod end portion 75 is specially configured to fit within the prongs formed by mounting plate 102 and the mounting plate and rod end portion are adapted to receive mounting pin 103 through complementary through-holes. Accordingly, piston and cylinder 21 at its cylinder end is mounted to the inside of second member 12 and at its piston rod end to the attached end of third member 13. As a result, the relative pivoted position of the second and third members around pivot point 18 may be selectively controlled by the extraction and retraction of piston and cylinder 21. When piston and cylinder 21 is fully retracted, members 12 and 13 will form an included angle, $\theta_5$, of approximately 70°.

In operation, the locomotive crane is coupled to a gondola car to be unloaded using typical coupling mechanism 30. Thereafter, the various pistons and cylinders are selectively supplied with actuating fluid through supply hoses 29, hydraulic pump 23 and hydraulic storage source 34 which enables the improved crane boom to be articulated to various positions across the entire length of gondola car 17. Electro magnet 24, or other appliance, is actuated through the use of electric power sources (not shown) or other means and metal scrap or other material is loaded and unloaded from the gondola car by the locomotive crane operator located in the locomotive cab 22 adjacent to the gondola car. As shown in FIG. 1, through the three point articulation of the improved boom device (i.e., around pivot points 15, 16 and 18), the operator may traverse the entire gondola car length without uncoupling the locomotive from the object gondola car. Moreover, the improved crane boom may easily reach the far end of the gondola car without violating the top edge thereof due to the specially configured first member and resulting angles $\theta_1$ and $\theta_2$. Accordingly, it is not necessary for the operator to couple and uncouple the locomotive from the object car, nor is it necessary for the operator to use an extensive amount of track space to complete loading and unloading. Moreover, articulation of the boom permits the operator to maintain a position directly adjacent the gondola car to be unloaded, thereby resulting in improved and efficient operation.

Prior art lattice booms, illustrated in FIG. 1*a*, require that the operator continually move the locomotive crane away from the car for unloading from front to back since articulation is precluded. This obscures the view of the operator and makes unloading or loading more time-consuming and inefficient. As can be seen from FIG. 1*a*, the typical lattice boom 25 is capable of pivoting around pivot point 26 only which would correspond to pivot point 15 in the preferred embodiment. The lattice boom is, of course, incapable of articulation or pivoting along its length and accordingly, has limited flexibility during the course of the loading or unloading process.

One of ordinary skill in the art will also readily appreciate that the improved boom is easily adaptable or retrofit to existing lattice cranes. In particular, the improved boom is adapted to be received at pivot point 15, 15*a* of the lattice-type locomotive cranes. In order to complete the retrofit operation, hydraulics 23 and hydraulic source 34, together with hydraulic lines 29 need to be added along with first piston and cylinder pair 19, 19*a*. This may be easily accomplished during the course of the retrofit operation. Moreover, the improved boom has nearly identical capacity to that of the lattice-type known in the prior art and accordingly, the locomotive crane looses no flexibility with respect to loading or unloading limits.

Thus, the improved boom provides an improved means for more efficiently loading and unloading a typical gondola car without the need for frequent and time-consuming movement of the locomotive crane. This greatly simplifies the unloading method and results in a significant time savings and more efficient operation.

MODIFICATIONS

The present invention contemplates that many changes and modifications may be made. For example, an improved boom may be designed to articulate or pivot around more or less than the three points shown in the preferred embodiment. Moreover, it is possible to incorporate additional loading and unloading appliances to the end of the improved boom and to add various power lines to accommodate such devices, e.g., additional hydraulic or electrical conduit. Moreover, it is contemplated that the boom members may be varied to include greater or lesser angles upon extraction and retraction depending upon the particular use anticipated for the improved device. Similarly, actuators other than pistons and cylinders may be used to articulate the boom members around the various pivot points.

Therefore, while the preferred embodiment of the improved crane boom has been shown and described, and several modifications thereof discussed, persons skilled in the art will readily appreciate that various additional changes and modifications may be made without departing from the spirit of the invention, as defined and differentiated by the following claims.

I claim:

1. An apparatus for loading and unloading vehicles comprising:

a first self-propelled vehicle with an operator's cab thereon, means on said first vehicle to couple an open-top load carrying elongated second vehicle thereto, said second vehicle having a far end and a near end relative to said first vehicle, said ends defining the length of said second vehicle, said second vehicle being coupled to said first vehicle at said near end;

a crane mounted on said first vehicle, said crane comprising an articulated boom with a first member having a first and a second section, said first and second sections being joined at an angle of substantially 160°, means mounting said first section to said first vehicle at a first point for pivotal movement about a horizontal axis;

a second member, means pivotally connecting said second member to said first member at a second point;

an elongated third member, means pivotally connecting said third member to said second member at a third point, a load handling appliance attached to an end of said third member;

a first actuator operatively connected between said first vehicle and a section of said first member for selectively pivoting said first member around said first point, said first actuator being operative to pivot said first section of said first member around said first point to respective maximum and minimum angles of substantially 80° and 55°, respectively from the horizontal;

a second actuator operatively connected between said first and second members for selectively pivoting, at least, said second member around said second point, said second actuator being operative to form a minimum angle of at least 80° between said first and second members;

a third actuator, operatively connected between said second and third members to selectively pivot said third member around said third point, said third actuator being operative to form a minimum angle of at least 70° between said second and third members;

a powered control system operatively connected to each of said actuators, means for selectively operating each of said actuators to pivot said members about said points;

whereby said load handling appliance can be placed at any desired position along said length of said second vehicle while said latter vehicle is coupled to said first vehicle, said load handling appliance being located at said near end of said second vehicle when said respective actuators move said first section of said first member to said maximum angle position relative to the horizontal and said second and third members to said minimum angle positions.

2. The device according to claim 1 wherein said first, second and third actuators are hydraulic pistons and cylinders.

3. The device according to claim 1 wherein said load handling appliance is an electromagnet appended to the end of said third member.

* * * * *